United States Patent [19]

Sanger

[11] Patent Number: 4,620,737

[45] Date of Patent: Nov. 4, 1986

[54] MANUALLY OPERABLE PERSONAL CONVENIENCE IMPLEMENT

[75] Inventor: Sampson D. Sanger, Liberty, N.Y.

[73] Assignee: Sanger-Nelken Enterprises, Clifton, N.J.

[21] Appl. No.: 689,447

[22] Filed: Jan. 7, 1985

[51] Int. Cl.[4] ..... A47J 51/06

[52] U.S. Cl. ..... 294/19.1; 223/111

[58] Field of Search ..... 294/19.1, 19.2, 24, 294/15, 17, 22, 53.5, 23; 223/111, 112, 113, 114, 115, 116, 117, 118; 2/303, 335

[56] References Cited

U.S. PATENT DOCUMENTS 4,231,603 11/1980 van Zelm ..... 294/19.1

4,238,061 12/1980 Marchetti et al. ..... 294/19.1

*Primary Examiner*—James B. Marbert

*Attorney, Agent, or Firm*—Carella, Byrne, Bain & Gilfillan

[57] ABSTRACT

A manually operable, multifunctional personal convenience implement consists of an upper arm, a lower arm and an interconnecting resilient hinge. The lower arm has a wedge shaped tip at its free end.

25 Claims, 19 Drawing Figures

22
52
58
56
54
55
57
59
59
53
60
60
20
21
27
61
61
61
24
23
50
46
37
50
24
42

MANUALLY OPERABLE PERSONAL CONVENIENCE IMPLEMENT

BACKGROUND OF THE INVENTION

Many activities of daily living are difficult not only for the physically handicapped, but also for others whose full range of motion is either minimally restricted or difficult to achieve. Such activities as dressing and undressing are extremely difficult for persons who cannot bend forwardly at the waist, move either or both of their lower extremities or use one of their upper extremities, the latter due to disability or restriction of the use of one or more of the shoulder, upper arm, forearm, wrist or hand.

For instance, as simple a task as donning or removing a stocking is difficult enough one-handed, but nearly impossible if one cannot easily bend forwardly at the middle or move the leg either in its entirety or at the knee. Persons who have restricted movement of the lower spine due to age, disease, trauma or obesity find it difficult to reach their feet even if the hip and knee joints are mobile and the leg musculature functional. Even if fully flexible at the waist, it is difficult to reach the feet if both the hips and knees are not fully mobile and the leg musculature functional. Any combination of disabilities of the lower spine, upper spine, hip and knee joints and leg, back or abdominal muscles can make such tasks as donning and removing shoes, stockings, hose and trousers extremely difficult even with fully functioning upper extremities. If, in addition, one of the upper extremities has limited function or range of motion, the problem is compounded in the extreme.

Persons who suffer from lack of mobility due to any reason, not only need assistance to dress and undress, but also obtain or manipulate a wide variety of articles such as telephone receivers, light pull chains or toggle switches, eating utensils, cups, glasses (drinking and optical), reading material and any other article or utensil which is just beyond arms reach. Merely by way of illustration, while lying in bed or on a sofa, a paraplegic may be unable to reach a telephone, drinking glass, cosmetic jar, reading material and the like on a nearby table. The wheelchair-bound homemaker may find it difficult to reach cooking utensils, food cartons, cans and the like just beyond reach from the wheelchair.

A working environment presents as many problems at the home. Clothes must be removed and put on and articles grasped though just beyond arms reach due to limitation of mobility.

Achieving mastery of activities of daily living, maintenance of the home and usefulness in the work environment is essential to both physical and psychological rehabilitation.

A wide variety of adaptive devices have been devised for the physically handicapped. However, in many instances they are useful only under limited circumstances and not useful for a wide variety of physical disabilities for a wide variety of purposes. No single device is available to assist the handicapped or physically restricted to don and remove shoes, stockings, hose, pantyhose, underwear and trousers and at the same time be useful to grasp such devices as telephone receivers, light chains and toggle switches, drinking and eating utensils, small boxes, cartons and bags.

It is among the objects and advantages of the present invention to provide a manually operable, multi-functional, personal convenience implement to assist in donning and removing shoes, stockings, hose, pantyhose, underwear and trousers as well as grasp small articles such as telephone receivers, light switches and chains, drinking and eating utensils, small jars, boxes, cartons, bags and dispensing tubes, jewelry and other personal items, and even to scratch the back.

Another object and advantage of the present invention is to provide an implement as aforesaid which can be assembled easily and quickly from injectionmolded plastic parts which are durable and can be cleaned and disinfected without damage.

SUMMARY OF INVENTION

A manually operable, multi-functional, personal convenience implement comprising an elongated upper arm having a longitudinal axis; an elongated lower arm, having a longitudinal axis, pivotally secured to the upper arm, the arms being pivotally movable with respect to each other in a plane, the respective arms each having a free end which free ends are mutually engagable and disengagable upon pivotal movement of the arms in said plane; wedge means at the free end of the lower arm; an upper surface on the wedge means extending generally arcuately outwardly and downwardly with respect to the plane of pivotal movement of the arms, said surface tapering inwardly toward the free end of said arm in a first plane generally perpendicular to the plane of pivotal movement of the arms, and tapering upwardly toward the free end of said arm in a second plane generally perpendicular to both the plane of pivotal movement of the arms and the first said plane.

PREFERRED EMBODIMENT OF THE INVENTION

The objects and advantages aforesaid, as well as other objects and advantages can be achieved by the implement disclosed and claimed herein, a preferred embodiment of which is illustrated in the drawings in which:

FIG. 1 is a top plan view of a preferred embodiment of the multi-functional implement for the physically impaired;

FIG. 2 is a top plan view of the upper arm of the implement shown in FIG. 1;

FIG. 3 is a side-elevational view of the upper arm of the implement shown in FIG. 2;

FIG. 4 is a side-elevational, cross-sectional view of the upper arm taken along line 3—3 in FIG. 2 looking in the direction of the arrows;

FIG. 5 is a bottom plan view of the upper arms of the implement;

FIG. 6 is a front-elevational cross-sectional view of the upper arm of the implement taken along line 6—6 in FIG. 2 looking in the direction of the arrows;

FIG. 7 is a rear-elevational cross-sectional view of the upper arm of the implement taken along line 7—7 in FIG. 2 looking in the direction of the arrows;

FIG. 8 is a top plan view of the lower arm of the implement;

FIG. 9 is a bottom-plan view of the lower arm of the implement;

FIG. 10 is a side-elevational view of the lower arm of the implement;

FIG. 11 is a side-elevational, cross-sectional view of the lower arm of the implement taken along line 11—11 in FIG. 8 looking in the direction of the arrows;

FIG. 12 is an oblique and elevational cross-sectional view of the lower arm of the implement taken along line 12—12 in FIG. 11 looking in the direction of the arrows;

FIG. 13 is a rear-elevational, cross-sectional view of the lower arm of the implement taken along line 13—13 in FIG. 8 looking in the direction of the arrows;

FIG. 14 is a rear-elevational, cross-sectional, view of the lower arm of the implement taken along line 14—14 in FIG. 8 looking in the direction of the arrows;

FIG. 15 is a side-elevational, cross-sectional assembly view taken along lines 3—3 in FIG. 2 and line 11 in FIG. 8 looking in the direction of the arrows;

FIG. 16 is a side-elevational view of a resilient hinge secured at the rear end of each of the upper arm and lower arm;

FIG. 17 is a top plan view of the hinge shown in FIG. 16;

FIG. 18 is a front-end elevational view of a locking sleeve;

FIG. 19 is a side-elevational, cross-sectional view of the locking sleeve shown in FIG. 18.

DESCRIPTION OF DRAWINGS

Referring now to the drawings in detail, specifically FIGS. 1 and 2 and the implement comprises an upper arm 20 and a lower arm 21. The upper arm 20 and lower arm 21 are secured together for pivotal movement with respect to each other in a plane by means of resilient hinge 22. The free end of upper arm 20 is provided with a smoothly contoured tip 23. The free end of the lower arm 21 is provided with a smoothly contoured wedge 24.

The upper arm 20 is preferably injection-molded from some suitable plastic which is limitedly resilient. In order to provide sufficient rigidity for use, the upper arm 20 is provided with a plurality of internal transverse structural ribs 25 and intersecting cross members 26, as shown in FIG. 5. The upper arm 20 is provided with a top 27.

Figure 1:
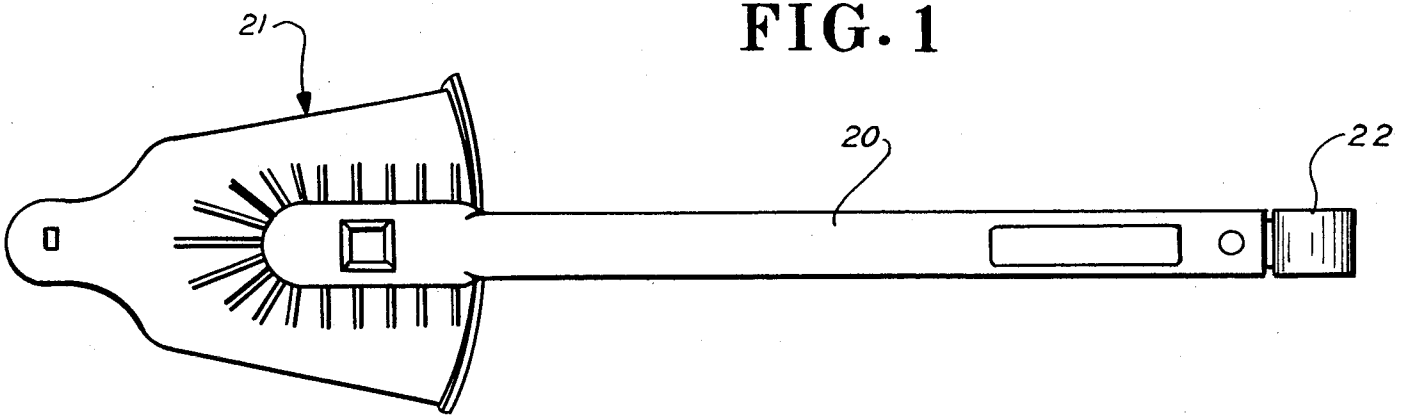
Figure 2:
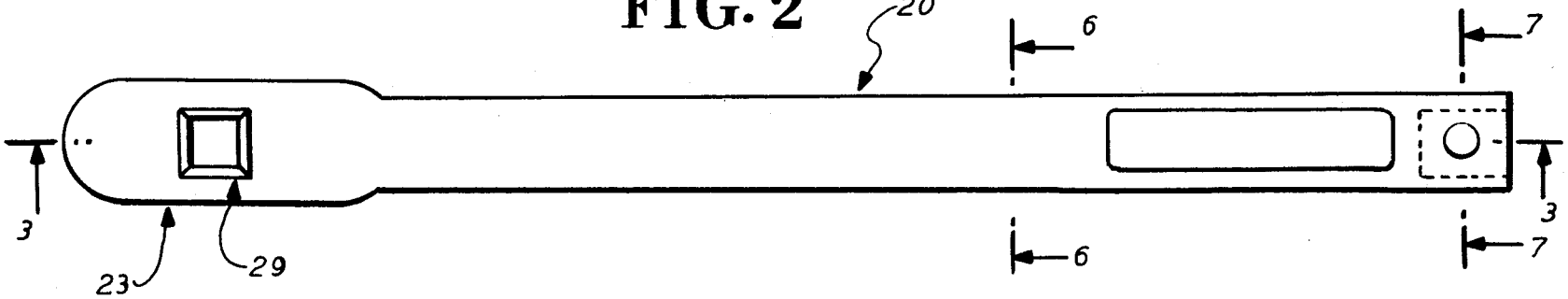
Figure 7:
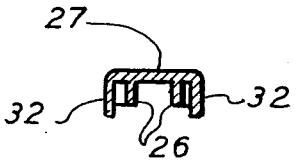
Figure 6:
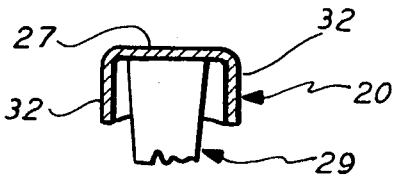
Figure 3:
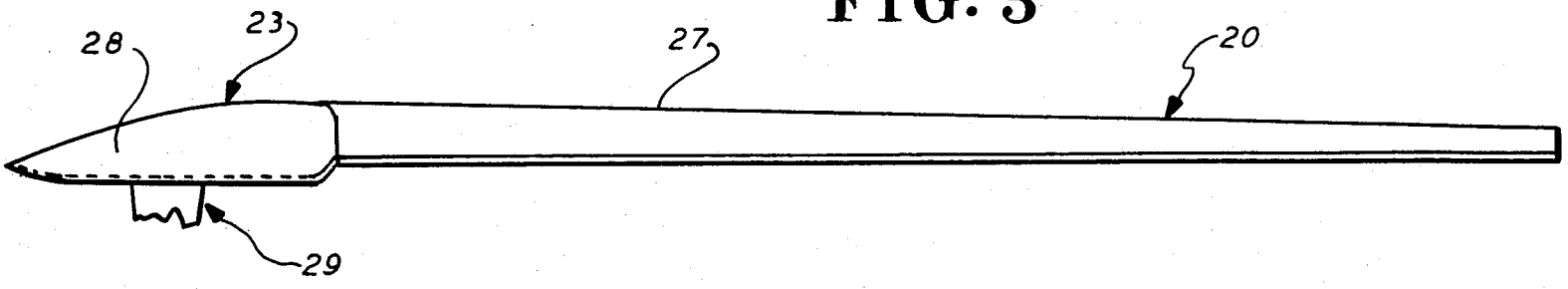
Figure 4:
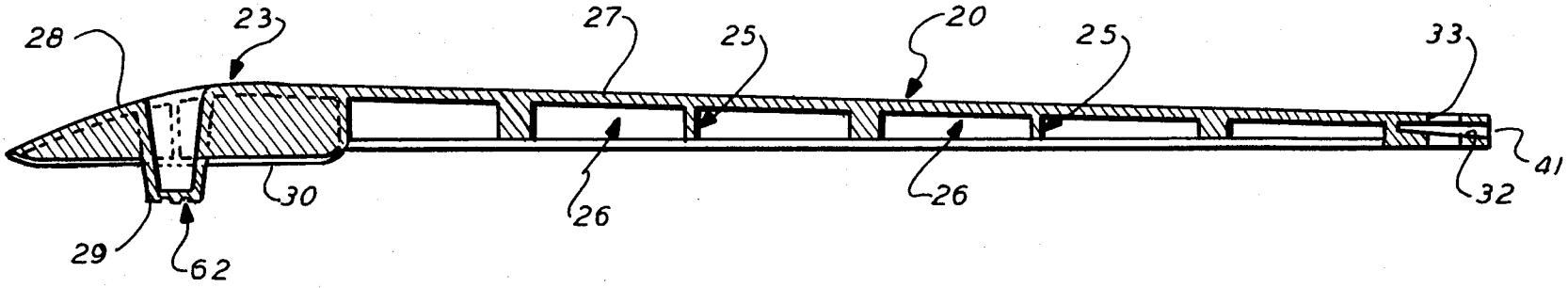
Figure 5:
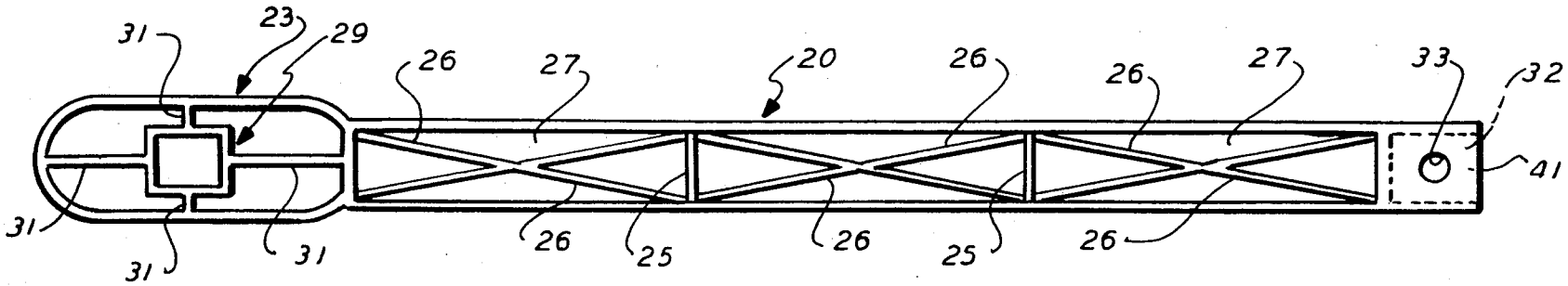

The tip 23 (FIGS. 3, 4 and 5) has a smoothly contoured upper surface 28 terminating arcuately with respect to the plane of the top 27, generally symmetrical with the longitudinal or longer axis of the arm 20. Surface 28 is interrupted by a depending post 29, which extends beneath the lower surface 30 of the tip 23. Preferably, the depending post 29 is formed integrally with the tip 23, which is in itself provided with stiffening ribs 31.

The upper arm 20 is also provided with side walls 32 preferably formed integrally with the top 27. It is preferable not to enclose the bottom of the arm 27 so as to insure complete cleaning without entrapped internal spaces, although the presence of a bottom to the arm 20 is optional.

The end of upper arm 20 connected to hinge 22 is provided with a transverse slot 41 running from side to side and a transverse bore 33 running from top to bottom. The slot 41 is tapered more narrowly from the end of arm 20 in the direction of tip 23..

The lower arm 21 (FIGS. 8 and 9) is comprised of a closed bottom 34 and side walls 35 and 36 preferably formed integrally with the bottom 34. As in the case of the upper arm 20, lower arm 21 is provided with transverse ribs 37, and cross member 38. As in the case of upper arm 20, lower arm 21 is not provided with a top closure, although the use of the same is optional.

The end of lower arm 21 to which the hinge 22 is mounted is provided with a transverse slot 39 which extends from side to side of the lower arm 21, and a transverse bore 40 extending from top to bottom and passing through the slot 39.

The free end of lower arm 21 distal to the hinge 22 is provided with a smoothly-contoured wedge 24. The wedge 24 is provided with a smoothly-contoured upper surface 42. A well 43 is provided in the upper surface 42 of the wedge 24 generally symmetrical with respect to the longitudinal axis of the lower arm 21. Preferably, upstanding detents 44 are provided at the bottom 45 of well 43.

Figure 11:
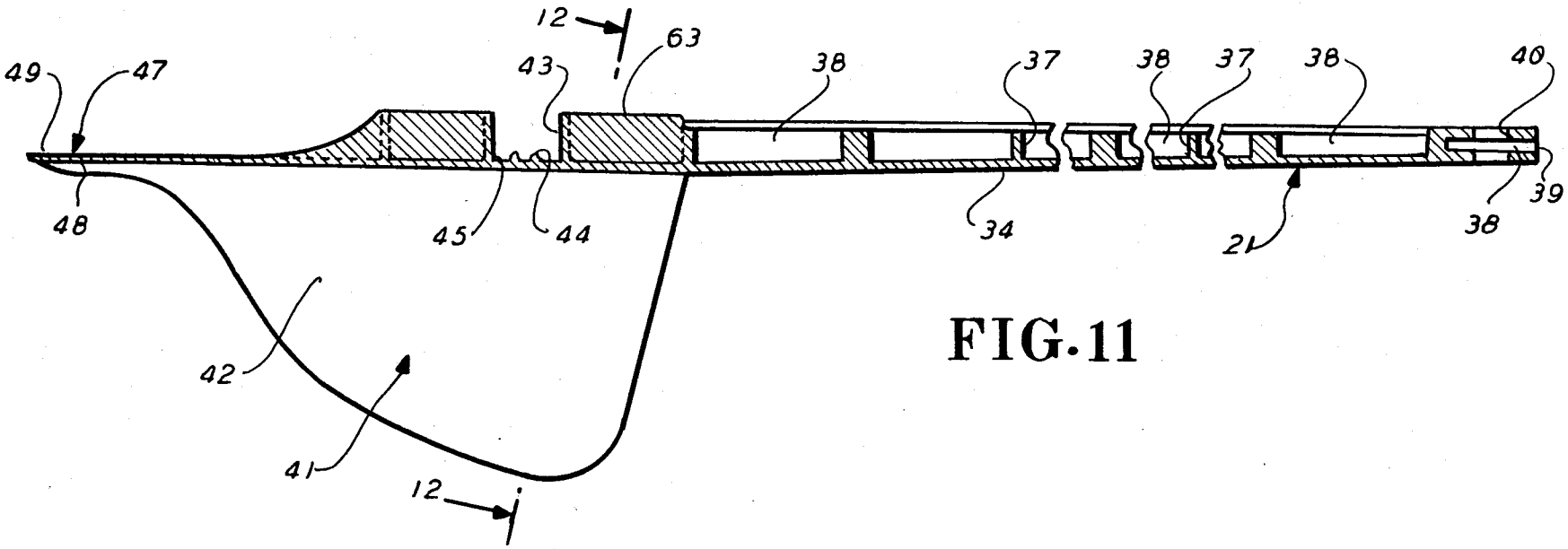
Figures 12, 13, 14, 15, 16, 17, 18, 19:
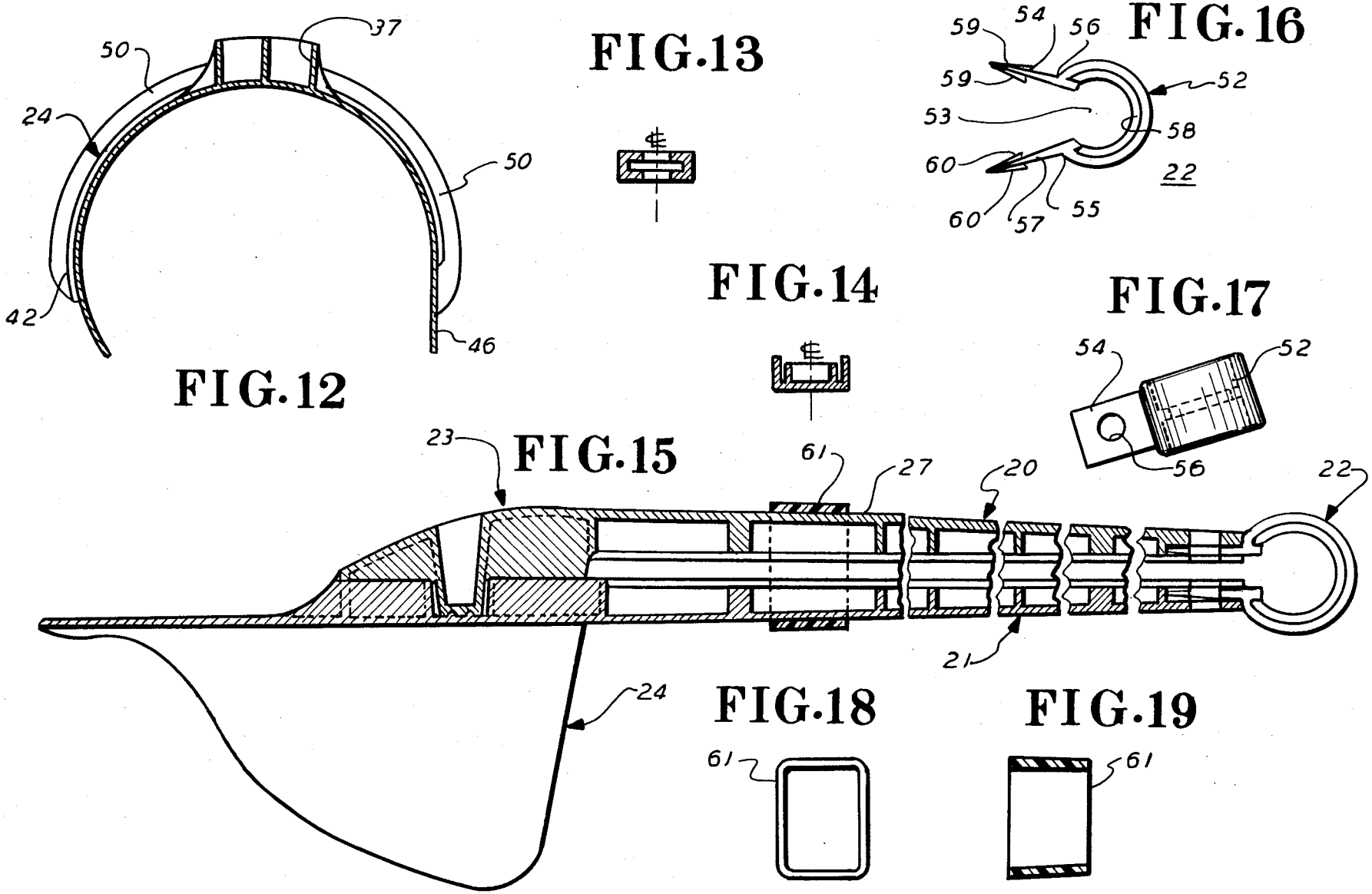

The upper surface 42 of wedge 24 has a generally arcuate-to-circular cross-sectional configuration taken along the line 12—12 in FIG. 11 as is shown in FIG. 12. However, the lower-most end of the wedge 24 on one side of the longitudinal axis of the arm 21 is provided with a flat or planar portion 46. This is for purposes of fabrication only. After removal from mold, both sides are curved inward so as to be symetrical.

Figure 8:
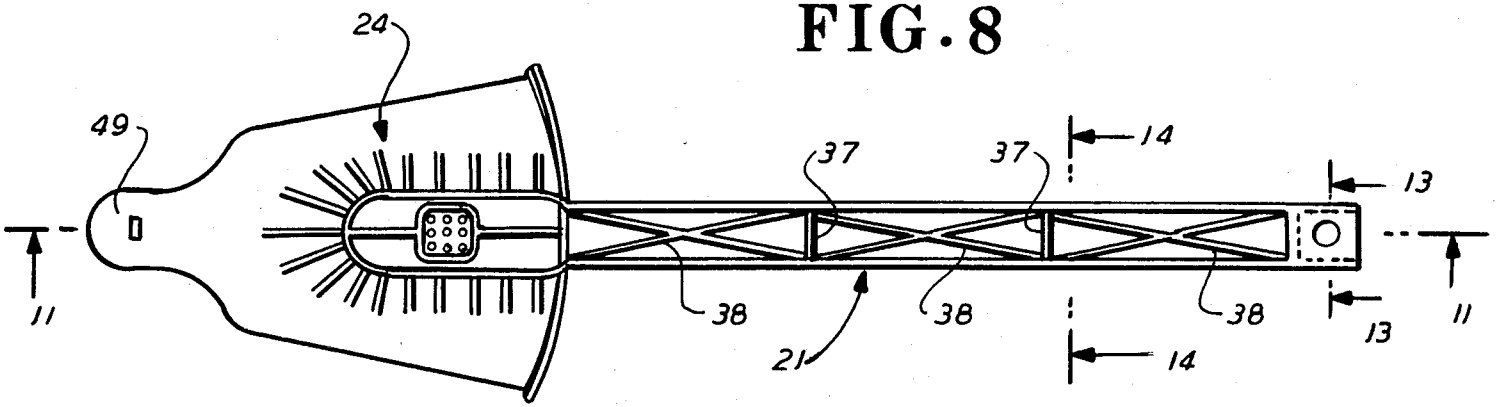
Figure 9:
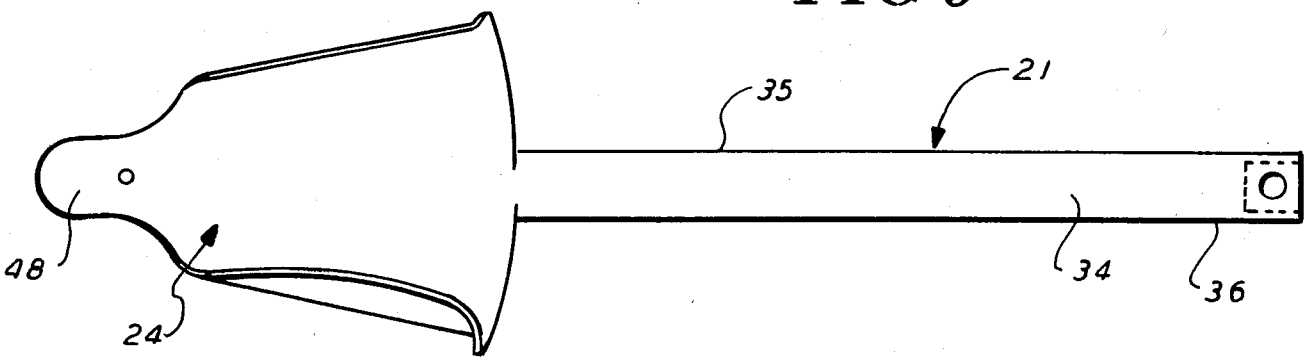
Figure 10:
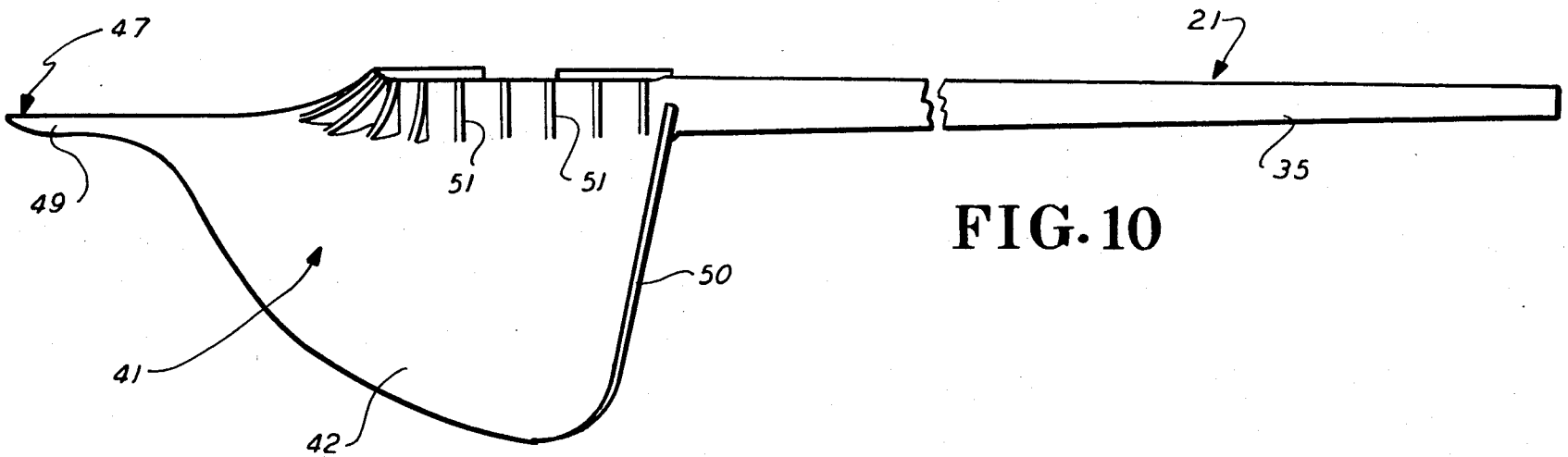

Viewed from above as illustrated in FIGS. 8 and 9, the wedge 24 tapers in the direction of the free end of arm 21. Viewed from the side as illustrated in FIGS. 10 and 11, the wedge 24 tapers arcuately upwardly toward the plane of the bottom 34 of the arm 21, terminating in a tip 47 which has a generally arcuate lower surface 48 and, preferably, a generally arcuate upper surface 49. The rear-most portion of the wedge 24 is provided with a radially outwardly flared lip portion 50. Wedge 24 is also provided with notches 66 having rounded eges as shown in FIGS. 9, 10, 11, 15.

The portion of the upper surface 42 of wedge 24 at the free end of arm 21 is provided with structural stiffening ribs 51.

The hinge 22 comprises an arcuate portion 52 which is discontinuous, terminating in an opening 53. The opposing ends of the arcuate portion 52 are provided with flat mounting plates respectively 54 and 55, each of which is provided with a transverse bore, respectively 56 and 57. Additionally, the interior of the arcuate portion 52 is provided with a re-enforcing rib 58.

The flat plate 54 of hinge 22 is intruded into the slot 39 in the upper arm 20 and the plate 55 is intruded into the slot 41 of the upper arm 20, thereby attaching the hinge 22 to the respective arms 20 and 21. The plates 54 and 55 are also provided wtih upstanding wedges, 59 and 60, which extend above and beneath the planes of the plates 54 and 55. Wedges 59 and 60 are adapted to engage the inside of the bores 56 and 57 respectively to secure the hinge 22 against accidental disengagements of the plates 54 and 55 from the respective slots 41 and 39. For additional security, a rivet or nut and bolt (not shown) may be employed in the bores 56 and 57 of the respective plates 54 and 55, as well as the bores 33 and 40 in arms 20 and 21, respectively.

The arcuate body portion 52 of hinge 22 is resilient and normally urges the free ends of arms 20 and 21 apart.

A collar or locking sleeve 61 is slidably mounted on and surrounds upper and lower arms 20 and 21. Preferably, the interior cross-sectional configuration of the collar 61 is the same as the cross-sectional configuration of the arms 20 and 21 when each lies in the same plane.

The upper and lower arms 20 and 21 are dimensioned such that the top 27 of upper arm 20 and the bottom 34 of lower arm 21 diverge from the hinge outwardly in the direction of the free ends thereof. The collar 61 is internally dimensioned larger than the cross-sectional dimension of the combined upper and lower arms 20 and 21 when the free ends thereof are engaged up to a point along the longitudinal axis of the respective arms distal to the hinge 22. At this point, as shown in FIG. 15, the collar 61 engages the top end and bottom respectively of arms 20 and 21 to hold the free ends of the arms in engagement against the bias of the resilient hinge 22. However, when the collar 61 is slid rearwardly from the position shown in FIG. 15 toward the hinge 22, the free ends of the arms 20 and 21 are free to move apart under the influence of the resilient hinge 22. Preferably, the arcuate body portion 52 of hinge 22 is sufficiently large to preclude disengagement of the collar 61 from the assembly.

The implement has multifunctional characteristics. Merely by way of illustration, it may be employed to both don and remove socks in the following manner. With the collar 61 is a position immediately adjacent to the hinge 22, the free ends of the upper and lower arms 20 and 21 are sufficiently spaced apart to permit the free passage of articles there between. In order to don a sock, the sock is pulled over the wedge 24 beginning with the tip 47 up to and preferably over the radially outwardly flared portion or flange 50, with a portion of the sock overlying the well 43. Alternatively the top of sock could be engaged in notches 66 to prevent slippage. Preferably, the sock is disposed on the wedge 24 which the heel disposed on the side opposite the well 43, and the tip 47 pointing in the direction of the toe of the sock. If the sock has a relatively long leg portion above the heel, it may be gathered on the upper surface 42 of the wedge 24.

The free ends of the upper and lower arms 20 and 21 are then manually drawn together against the bias of the spring hinge 22 until the depending post 29 at the free end of upper arm 20 is forceably intruded into the well 43 at the free end of the lower arm 21. The post 29 is dimensioned somewhat smaller than the well 43 so as to provide room for the fabric of the sock, at least at the sides. Additionally, when the post 29 is fully intruded into the well 43, the bottom 62 of the post 29 engages the bottom 45 of well 43. When the bottom 62 of post 29 is engaged to the bottom 45 of well 43, the undersurface 30 of the tip 23 on the upper arm 20 engages the upper surface 63 of the wedge 24 adjacent the well 43. Surfaces 30 and 63 are each provided with generally the same arcuate configuration to provide a large contact area.

With the implement held in the hand, the user reaches downwardly to his feet, intruding the toes of one of the feet into the opening provided at the rear-most portion of wedge 24. The user then retracts the implement and, with the sock firmly engaged by means of the cooperation of post 29 with well 43, it is drawn upwardly, pulling the sock onto the foot. To augment the cooperation of post 29 with well 43, the collar 61 is positioned near the free ends of the upper and lower arms 20 and 21 forcing them together.

In order to remove the sock effectively the reverse procedure is employed. The tip 47 of wedge 24 is inserted between the sock and the leg at the rear of the leg. The wedge 24 may be pointed either away from the leg or toward the leg. The free ends of the arms 20 to 21 are preferrably joined at this time. The implement is then pushed downwardly along the rear of the leg and foot removing the sock. Of course, the radially-outwardly flared portion 50 on the wedge 24 is useful to prevent the sock from riding over and past the wedge 24.

Normally, a person sufficiently handicapped to employ the implement wil not employ laced shoes but rather loafers in the following fashion. The tip 47 of wedge 24 is effectively in the form of a shoe horn. The tip 47 is intruded into the space between the foot and the shoe at the heel and pushed downwardly to remove the shoe. The shoe may be donned by placing the foot into the open portion of the shoe and employing the tip 47 as a shoe horn.

The implement may be employed in analagous fashions to don and remoe undergarments. In donning the undergarment, such as undershorts, panties, pantyhose and the like, the article is grasped between the free ends of arms 20 and 21, with the cooperation between the post 29 and well 43 sufficient to insure positive engagement. The garment may then be lowered to a position at the end of the foot and the foot placed into the garment in the usual fashion. Of course, the arms 20 and 21 are made sufficiently long so as to make it unnecessary for the user to bend significantly at the waist. The garment is then drawn upwardly until it can be reached by the hand, or alternatively drawn upwardly with the implement to the final position. It should be noted that if the undershorts, panties or pantyhose are gripped between the free ends of the upper and lower arms 20 and 21, an opening will be created at the rear-most portion of the wedge 24 to facilitate intrusion of the foot which would not be the case were the garment to be grasped simply by a pliers-like device. Moreover, as the wedge rises on the body, the garment is stretched so as not to bind to the body as it is being pulled upwardly. The implement may be employed to pick up articles other than garments. For instance, merely by way of illustration, the implement can be employed to pick up a telephone receiver. This is best done by opening the free ends of the upper and lower arms 20 and 21 and then intruding the free arm of 21 between the receiver and the base. The smooth wedge-shaped upper surface 28 of the free end of arm 20 will easily intrude between the hand set and base. With the free ends of arms 20 and 21 fully separated, it is relatively easy to pass the post 29 beyond the hand set so as to trap it between the free ends of arms 20 and 21 rearwardly of the post 29 and well 43.

Additionally, and merely by way of illustration, the implement can be employed to grasp a large number of rigid or flexible articles, such as jars, flexible tubes and the like. The post 29 provides useful means to prevent a rigid, circular, smoothwalled jar from slipping out of the grasp of arms 20 and 21 by moving toward the free end under pressure. The implement may also be provided with a sponge mitt that covers the wedge 24 and is secured thereto by the cooperation of post 29 with well 43.

The respective free ends of arms 20 and 21 may also be used individually to lift or, in the case of which 24, carry items. Each may also be employed to activate switches such as electric light wall switches. The wedge 24 is also useful as a backscratcher which can be quite important to persons lacking lower extremity mobility, particularly if wheelchair bound or bedridden.

Numerous modifications and variations of the present invention are possible in light of the above teachings and, therefore, within the scope of the appended claims, the invention may be practiced otherwise than as particularly described.

What is claimed:

1. A manually operable, multifunctional personal convenience implement comprising:

a. an upper arm having a longitudinal axis, a secured end, and a free end;

b. a lower arm having a longitudinal axis, a secured end, and a free end;

c. pivot means for pivotally securing the upper arm to the lower arm, allowing the upper and lower arms to be pivotally movable with respect to each other in a plane, the pivot means being connected to the secured end of the upper arm and the secured end of the lower arm;

d. first engagement means on the free end of the upper arm and second engagement means on the free end of the lower arm, the first and second engagement means being cooperatively engageable and disengageable with each other upon pivotal movement of the arms in said plane; and e. wedge means at the free end of the lower arm, having an upper surface extending generally arcuately outwardly and downwardly with respect to the plane of pivotal movement of the arms said surface tapering inwardly toward the free end of said arm in a first plane generally perpendicular to the plane of pivotal movement of the arms and tapering upwardly toward the free end of said arm in a second plane generally perpendicular to both the plane of pivotal movement of the arms and the first said plane.

2. A manually operable, multifunctional personal convenience implement in accordance with claim 1 and:

a. tip means at the free end of the upper arm, the tip means having a generally smoothly contoured upwardly convex upper surface.

3. A manually operable, multifunctional personal convenience implement in accordance with claim 1 and:

a. the first engagement means including gripping means on the free end of the upper arm engagable and disengagable with the second engagement means.

4. A manually operable, multifunctional personal convenience implement in accordance with claim 1 and:

a. the first and second engagement means including engagable and disengagable cooperative gripping means on the free ends of the upper and lower arms, respectively.

5. A manually operable, multifunctional personal convenience implement in accordance with claim 1 and:

a. the second engagement means including gripping means on the free end of the lower arm engagable and disengagable with the first engagement means.

6. A manually operable, multifunctional personal convenience implement in accordance with claim 1 and:

a. the first engagement means including at least a lower surface on the free end of the upper arm conforming to the second engagement means including at least a portion of the upper surface of the wedge means.

7. A manually operable, multifunctional personal convenience implement in accordance with claim 1 and:

a. the first engagement means includes a post depending from the free end of the upper arm; and b. the second engagement means includes a well located on the upper surface of the wedge means on the lower arm, the post intruding into the well when said free ends are pivoted toward engagement with each other.

8. A manually operable, multifunctional personal convenience implement in accordance with claim 7 and in which the post and well are dimensioned such that the side of the post is spaced away from the side of the well when the post is intruded into the well.

9. A manually operable, multifunctional personal convenience implement in accordance with claim 8 in which the post and well are dimensioned such that the bottom of the post is engagable with the bottom of the well when the post is intruded into the well.

10. A manually operable, multifunctional personal convenience implement in accordance with claim 1 and:

a. a radially outwardly flared portion on the rearmost aspect of the wedge means.

11. A manually operable, multifunctional personal convenience implement in accordance with claim 1 and:

a. a planar portion on the upper surface of the wedge means on one side of the lower arm portion of said wedge means.

12. A manually operable, multifunctional personal convenience implement in accordance with claim 11 and:

a. a radially outwardly flared portion on the rearmost aspect of the wedge means.

13. A manually operable, multifunctional personal convenience implement in accordance with claim 1 and:

a. a relatively more narrow portion on the wedge means at the free end of the lower arm defining a tip having a lower surface which is arcuate in a plane generally perpendicular to both the longitudinal axis of the lower arm and the plane of pivotal movement of the upper and lower arms.

14. A manually operable, multifunctional personal convenience implement in accordance with claim 13 and:

a. at least a portion of the upper and lower surfaces of the wedge means generally conforming to each other at the tip.

15. A manually operable, mutlifunctional personal convenience implement in accordance with any one of claims 10, 11, 12, 13 or 14 and:

a. a lower surface on the wedge means generally conforming to the upper surface thereof on opposite sides of the lower arm.

16. A manually operable multifunctional personal convenience implement in accordance with any one of claims 2, 3, 4, 5, 6, 7, 8 and 9:

a. a radially outwardly flared portion on the rearmost aspect of the wedge means.

17. A manually operable multifunctional personal convenience implement in accordance with any one of claims 2, 3, 4, 5, 6, 7, 8 and 9 and:

a. a planar portion on the upper surface of the wedge means on one side of the lower arm at the lowermost portion of said wedge means.

18. A manually operable, multifunctional personal convenience implement in accordance with any one of claims 2, 3, 4, 5, 6, 7, 8 and 9 and:

a. a radially outwardly flared portion on the rearmost aspect of the wedge means; and b. a planar portion on the upper surface of the wedge means on one side of the lower arm at the lowermost portion of said wedge means.

19. A manually operable, multifunctional personal convenience implement in accordance with any one of claims 2, 3, 4, 5, 6, 7, 8 and 9 and:

a. a relatively more narrow portion on the wedge means at the free end of the lower arm defining a tip having a lower surface which is arcuate in a plane generally perpendicular to both the longitudinal axis of the lower arm and the plane of pivotal movement of the upper and lower arms.

20. A manually operable, multifunctional personal convenience implement in accordance with any one of claims 2, 3, 4, 5, 6, 7, 8 and 9 and:

a. a lower surface on the wedge means generally conforming to the upper surface thereof on opposite sides of the lower arm.

21. A manually operable, multifunctional personal convenience implement in accordance with any one of claims 1, 2, 3, 4, 5, 6, 7, 8, 9, 10, 11, 12, 13 and 14 and:

a. the pivot means includes a resilient means normally urging the free ends of the upper and lower arms apart.

22. A manually operable, multifunctional personal convenience implement in accordance with any one of claims 1, 2, 3, 4, 5, 6, 7, 8, 9, 10, 11, 12, 13 and 14 and:

a. the pivot means includes a resiliently biased hinge connecting the arms for mutually pivotal movement and normally urging the free ends thereof apart.

23. A manually operable, multifunctional personal convenience implement in accordance with any one of claims 1, 2, 3, 4, 5, 6, 7, 8, 9, 10, 11, 12, 13 and 14 and:

a. the pivot means includes resilient means biasing the upper and lower arms normally urging the free ends apart; and b. manually operable means to secure the free ends of the arms together against the bias of the resilient means.

24. A manually operable, mulifunctional personal convenience implement in accordance with any one of claims 1, 2, 3, 4, 5, 6, 7, 8, 9, 10, 11, 12, 13 and 14 and:

a. an upper surface on the upper arm;

b. a lower surface on the lower arm, the said upper and lower on the respective arms diverging from their pivotal joinder when the free ends of the arms are engaged;

c. the pivot means includes resilient means normally urging the free ends of the arms apart; and d. a collar longitudinally slidably mounted on and surrounding the arms, the collar being dimensioned to snuggly engage the respective said upper and lower surfaces on the arms as it is moved in the direction of the free ends thereof when said free ends are engaged.

25. A manually operable, multifunctional personal convenience implement in accordance with any one of claims 1, 2, 3, 4, 5, 6, 7, 8, 9, 10, 11, 12, 13 and 14 and:

a. notch means on the periphery of the lower surface of the wedge means adjacent its rear most aspect.

* * * * *